US006369326B1

(12) United States Patent
Rippel et al.

(10) Patent No.: US 6,369,326 B1
(45) Date of Patent: Apr. 9, 2002

(54) RECESSED FIXTURE HOUSING

(75) Inventors: Graham M. Rippel, South Easton; Mark O. Jones, South Dartmouth, both of MA (US); Robert J. Wedekind, Riverside; Robert C. Ferzan, Tiverton, both of RI (US)

(73) Assignee: Genlyte Thomas Group LLC, Louisville, KY (US)

( * ) Notice: Subject to any disclaimer, the term of this patent is extended or adjusted under 35 U.S.C. 154(b) by 0 days.

(21) Appl. No.: 09/657,286

(22) Filed: Sep. 7, 2000

(51) Int. Cl.[7] ..... H01H 13/06
(52) U.S. Cl. ..... 174/58; 174/50; 52/27
(58) Field of Search ..... 174/50, 58, 59, 174/54, 65 R, 66, 67; 220/3.2, 3.3, 3.5, 3.8, 241, 3.6, 3.7, 4.33, 4.02, 622; 52/27, 28; 248/343, 906; 362/365, 364

(56) References Cited

U.S. PATENT DOCUMENTS 1,264,015 A * 4/1918 Cochrane ..... 220/4.33
3,281,522 A * 10/1966 Anisfield ..... 174/50
4,408,262 A * 10/1983 Kusmer ..... 362/147
4,751,624 A 6/1988 Russo et al.
4,754,377 A 6/1988 Wenman
5,222,800 A 6/1993 Chan et al.
5,272,279 A * 12/1993 Filshie ..... 174/50
5,452,816 A * 9/1995 Chan et al. ..... 220/3.8
5,707,143 A 1/1998 Hentz
5,758,959 A 6/1998 Sieczkowski
5,836,678 A * 11/1998 Wright et al. ..... 362/364
5,857,766 A 1/1999 Sieczkowski
5,957,573 A 9/1999 Wedekind et al.
5,957,574 A * 9/1999 Hentz et al. ..... 362/365
6,062,704 A * 5/2000 Holder ..... 362/223
6,098,825 A * 8/2000 Kohnen ..... 220/3.2
6,272,794 B1 * 8/2001 Rippel et al. ..... 52/27

* cited by examiner

*Primary Examiner*—Dean A. Reichard
*Assistant Examiner*—Angel R. Estrada
(74) *Attorney, Agent, or Firm*—Jeffrey A. Haeberlin; Middleton Reutlinger; Charles G. Lamb

(57) ABSTRACT

A recessed fixture housing in which the major components are designed with taper fits to allow the components to be pressed together in assembly to create an air-seal engagement construction. The fixture housing also provides a junction box accessible from either the room side or the attic side of a fixture, while maintaining a sealed fixture housing. Further, a recessed fixture frame for use with a housing of maximal size to be installed between building structural members with mounting bars having protruding tabs. Mounting bar brackets are inset from each frame side an amount sufficient to accommodate the tabs between the building structural member and the bracket.

35 Claims, 8 Drawing Sheets

RECESSED FIXTURE HOUSING

BACKGROUND OF THE INVENTION

1.Field of the Invention

This invention relates to recessed fixtures, and particularly to an improved fixture housing providing reduced airflow through the fixture without the use of additional sealing materials.

2. Description of Prior Art

As an energy conservation measure, many buildings are being constructed with a continuous vapor/air-flow barrier between conditioned (heated or cooled) spaces and unconditioned spaces (attics, wall cavities, etc.). The intent of the barrier is to retain conditioned air within the building's outer envelope thereby reducing heating/cooling energy costs and to reduce the seepage of moisture into unconditioned spaces where condensation would damage materials. To meet this demand, it is becoming increasingly popular for recessed fixtures, such as recessed lighting fixtures, to be constructed with sealed housings to reduce airflow through the fixture. The Model Energy Code, Washington State Energy Code and many local ordinances require lighting fixtures with sealed housings that comply with prescribed leakage testing conducted in accordance with ASTM E283 "Standard Test Method for Rate of Air Leakage Through Exterior Windows, Curtain, Walls, and Doors" standards. Additionally, many utilities offer rebate programs that promote sealed fixtures.

Further complicating sealed fixture design are requirements that fixture wiring be accessible at a junction box at each fixture for installation and maintenance purposes. Additionally, sealed fixtures rated for both ceiling and no-ceiling access must allow for a sealable opening in the housing to access the junction box from either the room side or the attic side of the fixture.

Commercially available sealed lighting fixtures are typically provided with gaskets, tapes and/or chemical sealant applied at the seams and holes in their housings. These sealing methods involve costly materials, complicate fixture assembly and may degrade over time and may not properly reseal.

To properly dissipate heat generated by a lamp (bulb), sealed recessed light fixtures require housings having sufficient volume. It is an industry standard to provide mounting bars to mechanically attach recessed fixtures to building structural members. These bars have length exceeding the width of the fixture mounting frame because the mounting frame is usually rectangular. Buildings have structural members spaced at distances prescribed by code. These factors sometimes conflict with each other and a fixture having maximal volume for heat dissipation has a mounting frame size which will not allow mounting bars to fit between building members.

SUMMARY OF THE INVENTION

Thus, it is an object of the present invention to provide a recessed fixture housing which does not require the use of gaskets, tapes or chemical sealant materials to create a sealed housing.

It is another object of the present invention to provide a recessed fixture which eliminates the need for additional components to achieve or surpass air-seal requirements as defined in ASTM E283.

It is a further object of the present invention to provide a recessed fixture housing in which the major components are designed with taper fits to allow the components to be pressed together in assembly to create an air-seal construction.

It is another object of the present invention to provide a sealed recessed fixture housing having a junction box which is accessible from either the room side of the fixture or the ceiling side of the fixture.

It is another object of the present invention to provide a recessed fixture frame for use with a housing of maximal size to be installed between building members arranged with minimal spacing.

Preferably, the recessed fixture housing of the present invention has a mounting frame section having a bottom and a raised wall extending therefrom, a housing wall section having a bottom rim, a top rim, and a side wall, said side wall having a junction box opening, a housing cover section having a top and a skirt depending therefrom, and a junction box. The mounting frame raised wall and housing wall section bottom rim are in an air-seal engagement, and the housing wall section bottom rim and said housing cover section skirt are also in an air-seal engagement. The junction box is received within said junction box opening; and the junction box and side wall are also in an air-seal engagement, said air-seal engagement sealing the junction box opening.

Additionally, the preferred recessed fixture frame of the present invention has a pair of mounting bar assemblies having bar sections, mounting stubs at the ends of the bar sections, tabs protruding from the bar section, and notches between each tab and mounting stub. Each mounting bar assembly is slidably attached to the mounting bar brackets of a mounting frame section. The mounting frame section is narrow enough to fit between a building's structural members. The mounting frame section mounting bar brackets are inset from each side an amount sufficient to accommodate the mounting stubs and tabs of each mounting bar assembly between the building structural member and the bracket.

DETAILED DESCRIPTION OF THE PREFERRED EMBODIMENT

A. Fixture Housing

Figure 1:
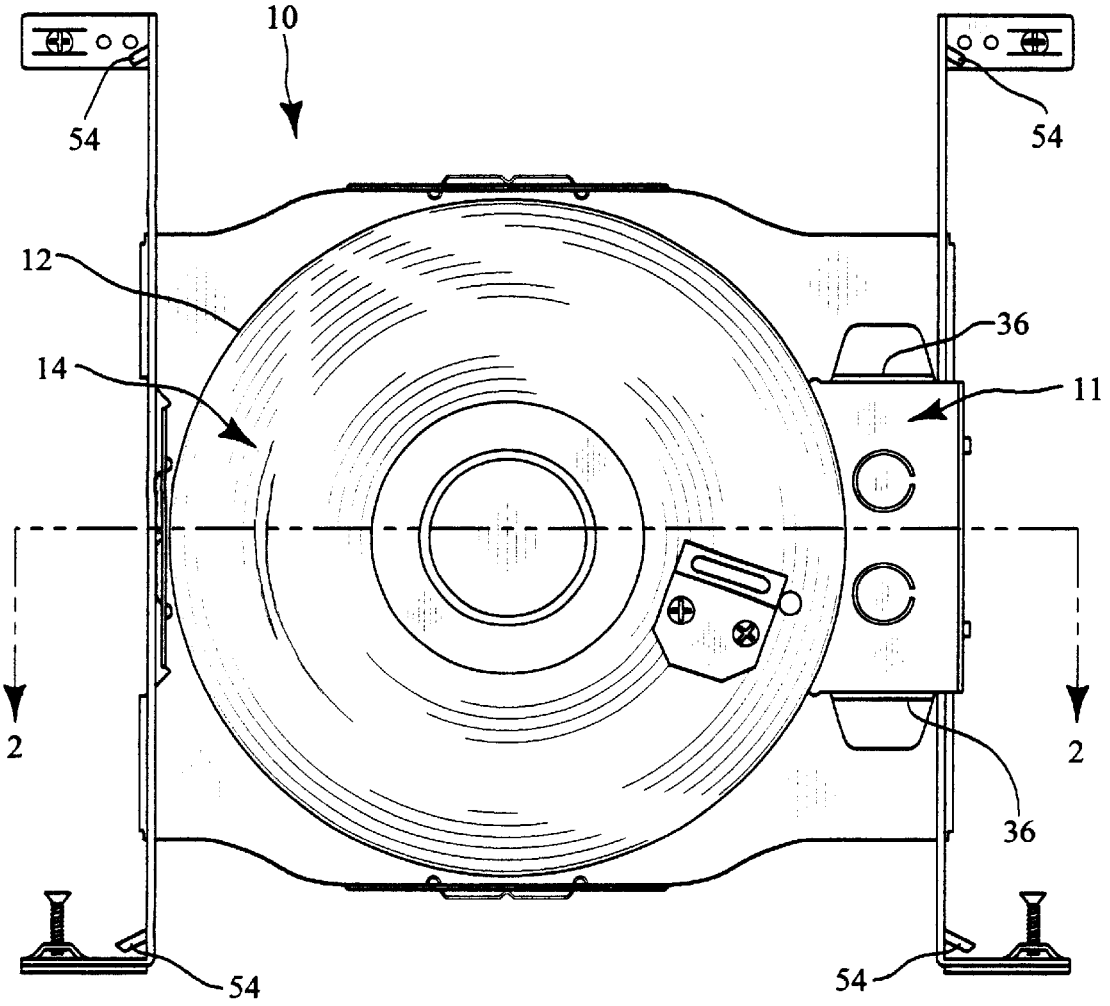
FIG. 1 is a top view of recessed fixture housing of the present invention.
Figure 2:
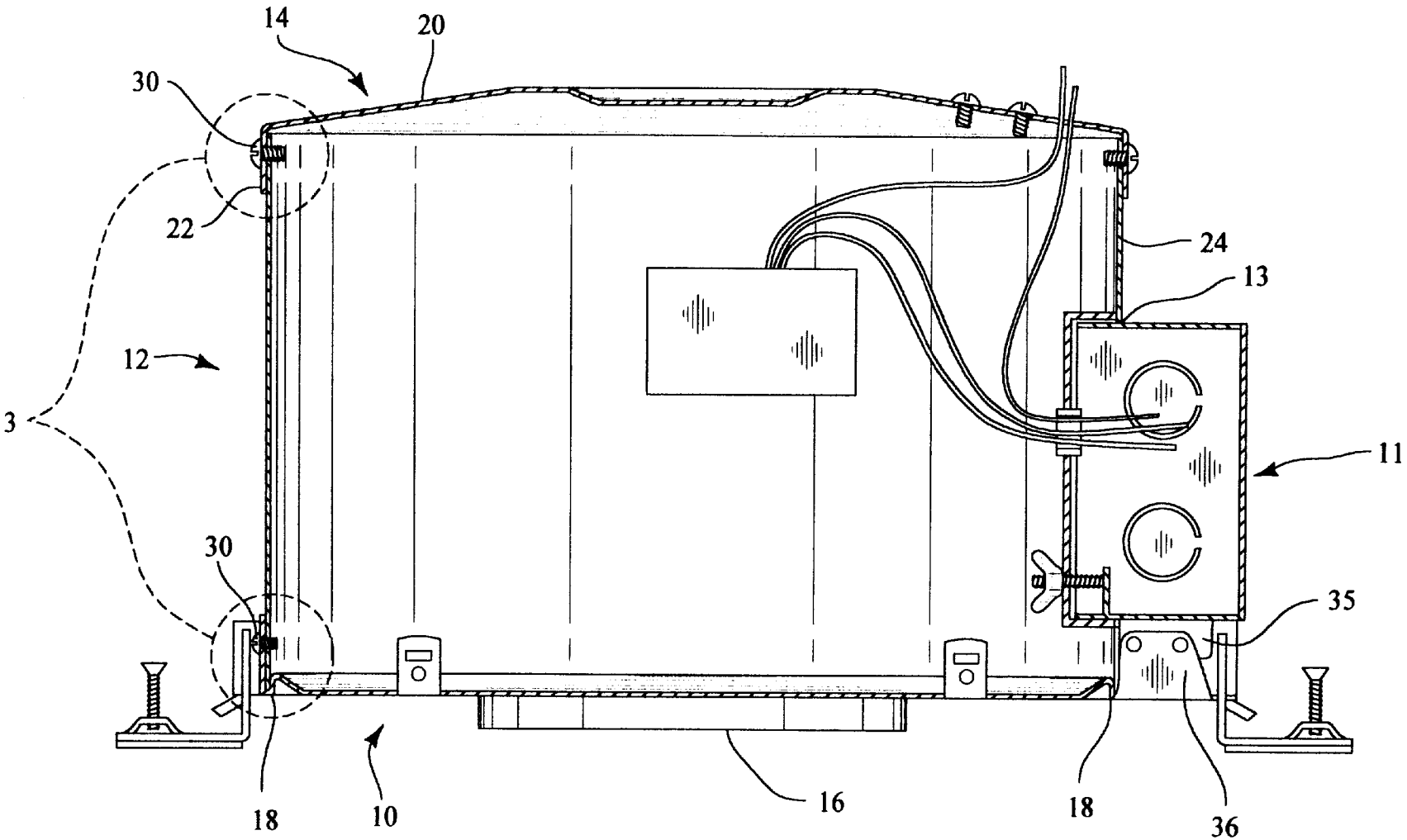
FIG. 2 is a sectional view taken along line 2—2 of FIG. 1.

As shown in FIGS. 1 and 2, the recessed fixture housing of the present invention has four major components, namely a mounting frame section 10, a housing wall section 12, a housing cover section 14, and a junction box 11.

Mounting frame section 10 has a central opening 16, through which a reflector (not shown) or other appliance may be installed. In the preferred embodiment, central opening 16 is circular and sized to accept a standard recessed fixture reflector. It should be recognized, however, that central opening 16 may be of any size or shape which mounting frame section 10 will accommodate.

Figure 3A:
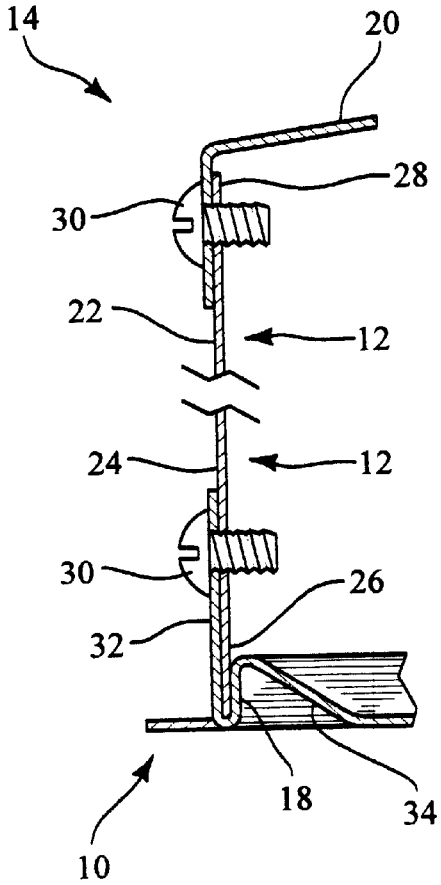
FIG. 3*a* a partial sectional view of detail 3 of FIG. 2.
Figure 3:
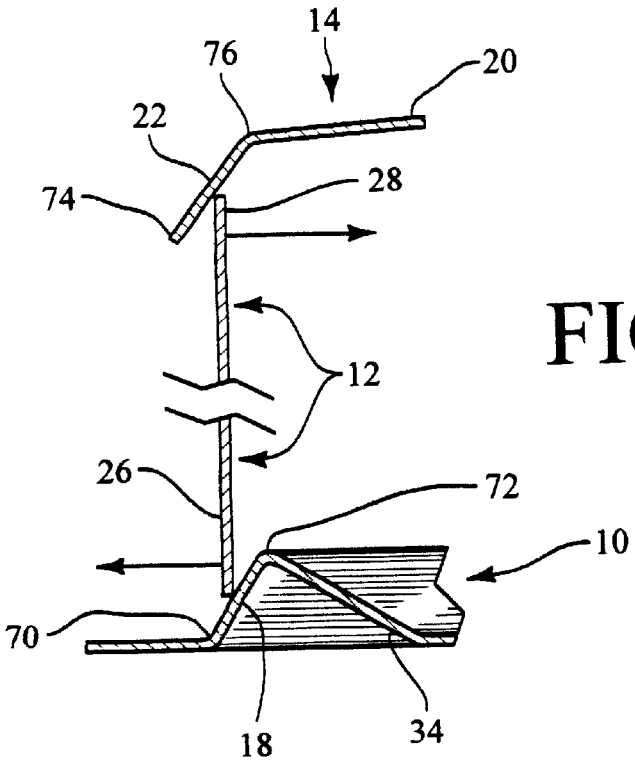
FIG. 3 is a partial sectional view of detail 3 of FIG. 2, without fasteners or a collar tab.

As shown in FIG. 3, mounting frame section 10 also has a raised wall 18 extending upward from the mounting frame section 10. The raised wall 18 has a slight inward cant or taper. In the preferred embodiment, raised wall 18 is frustoconically shaped. Other shapes, however, may be utilized.

Additionally shown in FIG. 3, housing cover section 14 has a top piece 20 and a skirt 22 extending downward from the top piece 20. The skirt 22, similar to the raised wall 18, also has a slight cant or taper outward from top piece 20. Likewise, in the preferred embodiment, skirt 22 is frustoconically shaped, but other shapes may be utilized.

The housing wall section 12 of the preferred embodiment is cylindrically shaped, the shape being coincidental to the shape of mounting frame section raised wall 18 and housing cover section skirt 22. The housing wall section 12 has a side wall 24 and an open top and bottom. Housing wall section 12 is outwardly flexible along its bottom rim 26 and inwardly flexible along its top rim 28. Most importantly, housing wall section 12 is sized such that the bottom rim 26 perimeter is smaller than the outer perimeter 70 of the mounting frame raised wall 18, but larger than the inner perimeter 72 of the mounting frame raised wall 18. Further, housing wall section 12 is also sized such that the top rim 28 perimeter is smaller than the outer perimeter 74 of the housing cover skirt 22, but larger than the inner perimeter 76 of the housing cover skirt 22. Preferably, housing wall section bottom rim 26 is sized to meet raised wall 18 midway between its outer perimeter 70 and inner perimeter 72. Likewise, housing wall section top rim 28 is sized to meet housing cover skirt 22 midway between its outer perimeter 74 and inner perimeter 76.

Also shown in FIG. 3, in the preferred embodiment, the mounting frame raised wall 18 is formed as the outer face of an inverted v-shaped groove 34.

Flexibility of the housing wall section rims 26, 28 of the preferred embodiment is achieved by fabrication of the section by rolling an approximately 0.032 inch thick sheet of aluminum or galvanized steel such that the cylindrical shape is formed. A seam will be formed where the ends of the sheet meet. A seal may be formed at the seam by forming a step down portion on one end, and setting the other end into the step. Fasteners may then be used to hold the seam together.

Assembly may be accomplished by placing the housing cover section skirt 22 over the housing wall section flexible top rim 28, and the housing wall section flexible bottom rim 26 over the mounting frame section raised wall 18. By applying a downward force on the housing cover section 14, housing wall section flexible top rim 28 will flex inward slightly, allowing the housing cover section 14 to seat on the housing wall section 12 with housing cover skirt 28 compressing housing wall section flexible top rim 22 and creating an air-seal engagement. By air-seal engagement, it is meant that the engagement between the elements meets the reduced airflow requirements set forth herein.

The downward force on the housing cover section 14 will be further transmitted through housing wall section causing housing wall section flexible bottom rim 26 to flex outward slightly, allowing housing wall section 12 to seat on the mounting frame section 10 with housing wall section flexible bottom rim 26 compressing mounting frame section raised wall 18 and creating an air-seal engagement.

Figure 11:
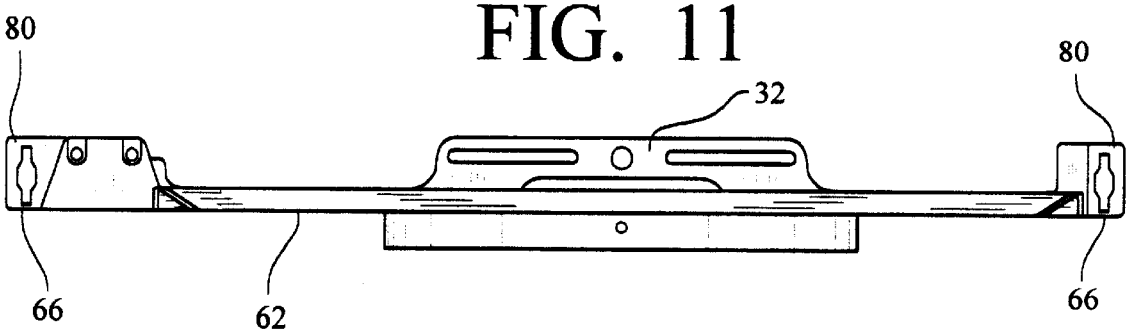
FIG. 11 is a side view of the mounting frame section of FIG. 10.

As shown in FIG. 3*a,* the preferred embodiment utilizes sheet metal screws 30 through housing cover section skirt 22 and into housing wall section 12 to hold housing cover section 14 downward and in compressive contact with housing wall section 12. Also, specifically in the preferred embodiment, collar tabs 32 extend upward from mounting frame section 10, providing a member through which sheet metal screws 30 may hold housing wall section 12 downward in position over mounting frame section 10. Collar tabs 32 are also shown in FIG. 11. Housing wall section 12 could, however, also be held downward in position over mounting frame section 10 by otherwise fastening housing wall section 12 to mounting frame section 10, such as directly to mounting frame section raised wall 18.

Also shown in FIGS. 1 and 2 is junction box 11, which is recessed into housing wall section junction box opening 13.

Figure 4:
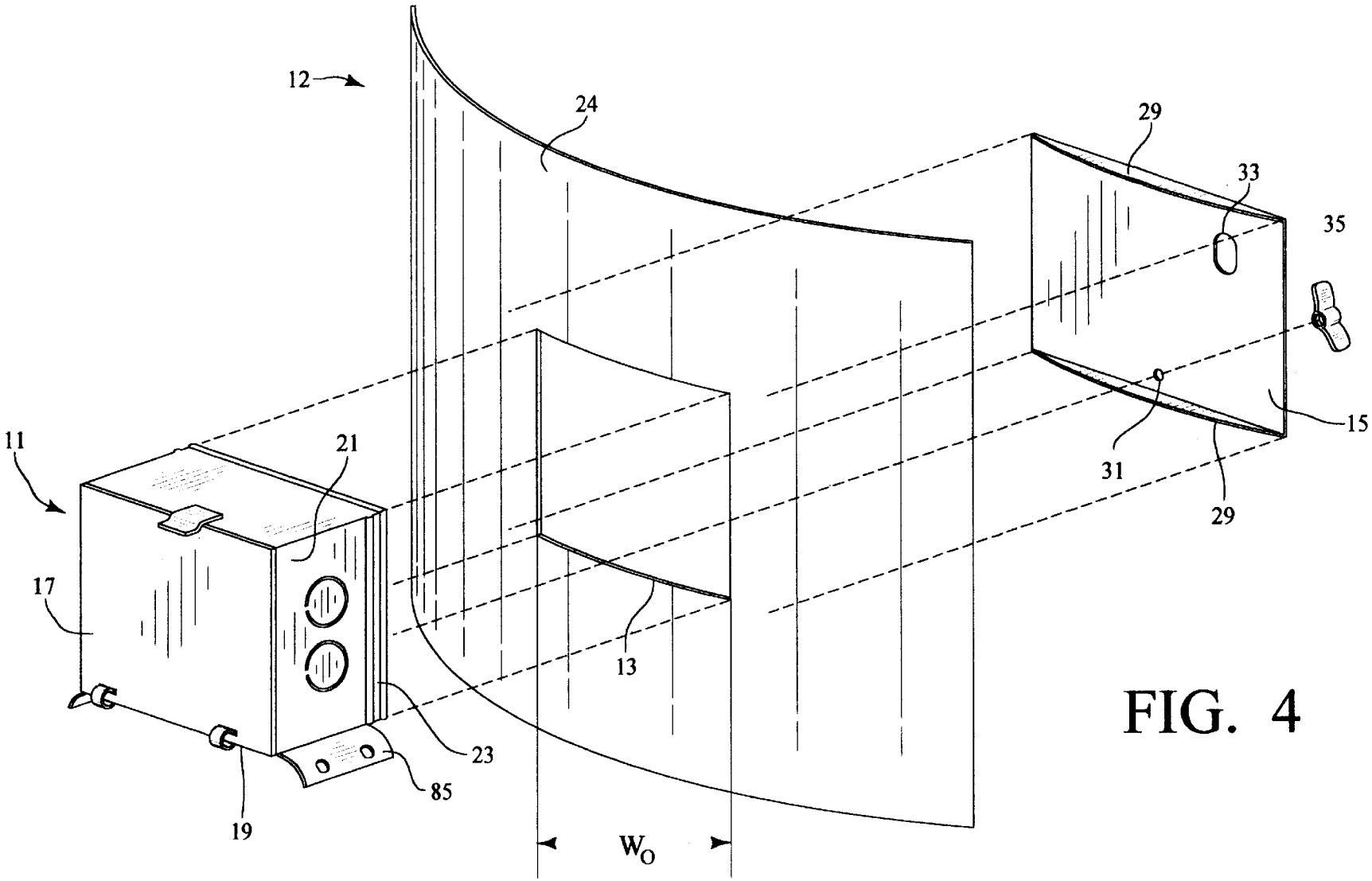
FIG. 4 is a perspective exploded view of a portion the recessed fixture housing of FIG. 1, taken from outside the junction box area of the fixture housing.

As shown in FIG. 4, junction box 11 has an inner door 15, an outer door 17, a junction box plate 19, and sides 21.

Sides 21 have ribs 23. Ribs 23 serve to strengthen the rigidity of the junction box 11. Junction box 11 is slightly wider than the width, $w_o$, of the housing wall section junction box opening 13, such that the side edges of junction box opening 13 seat in ribs 23 along the inside edge of the junction box sides 21. Thus, side edges of junction box opening 13 provide slight compression against junction box sides 21, further strengthening the rigidity of junction box 21 for attachment of conduit (not shown) or the pulling of electrical wires (not shown) into junction box 11.

Figure 5:
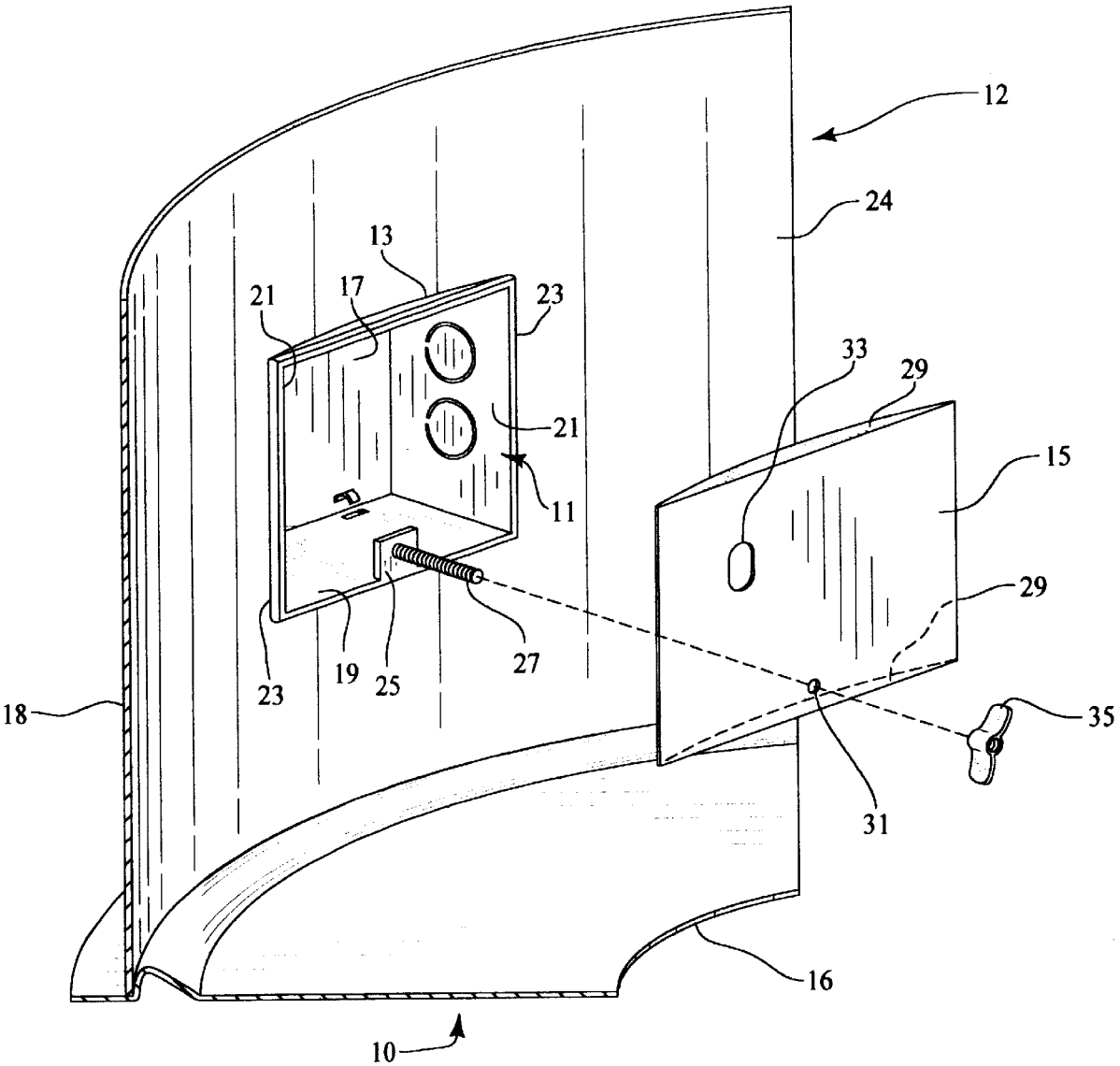
FIG. 5 is a perspective exploded view of a portion of the recessed fixture housing of FIG. 1, taken from inside the junction box area of the fixture housing.

Junction box plate 19 has wings 85 which extend wider than the width, $w_o$, of the housing wall section junction box opening 13 and attach to mounting frame section junction box bracket 36, as shown in FIG. 2. As shown in FIG. 5, junction box plate 19 has an upturned bolt holding tab 25 which holds bolt 27.

Inner door 15 has arcuate flanges 29, bolt receiving hole 31, and wiring hole 33. Inner door 15 is slightly wider than the width, $w_o$, of the housing wall section junction box opening 13 in order to cover the junction box opening 13 completely. Arcuate flanges 29 are contoured to the surface of the housing wall section 12.

Thus, inner door 15 may be placed over housing wall section junction box opening 13 such that its sides and the edges of arcuate flanges 29 fit flush against the inside of housing wall section 12. Bolt 27 is received by bolt receiving hole 31. Wing nut 35 may then be tightened against inner door 15 forcing the inner door sides and the edges of arcuate flanges 29 tightly against the inside of housing wall section 12, creating a air-seal along the housing wall section/inner door interface. Further, inner door 15 reinforces housing wall section 12 in the area of housing wall section junction box opening 13.

Wiring hole 33 will accommodate wiring, as shown in FIG. 2, to the interior of the fixture housing. A wiring strain relief 36 will serve, in addition to relieving wiring strain, to further restrict the flow of air through the fixture housing.

Thus, wiring to the fixture may be accessed from either the room side or the attic side of the fixture through either junction box inner door 15 or outer door 17, while maintaining a strongly rigid junction box 11 and substantially air-tight fixture.

B. Fixture Frame

Figure 6:
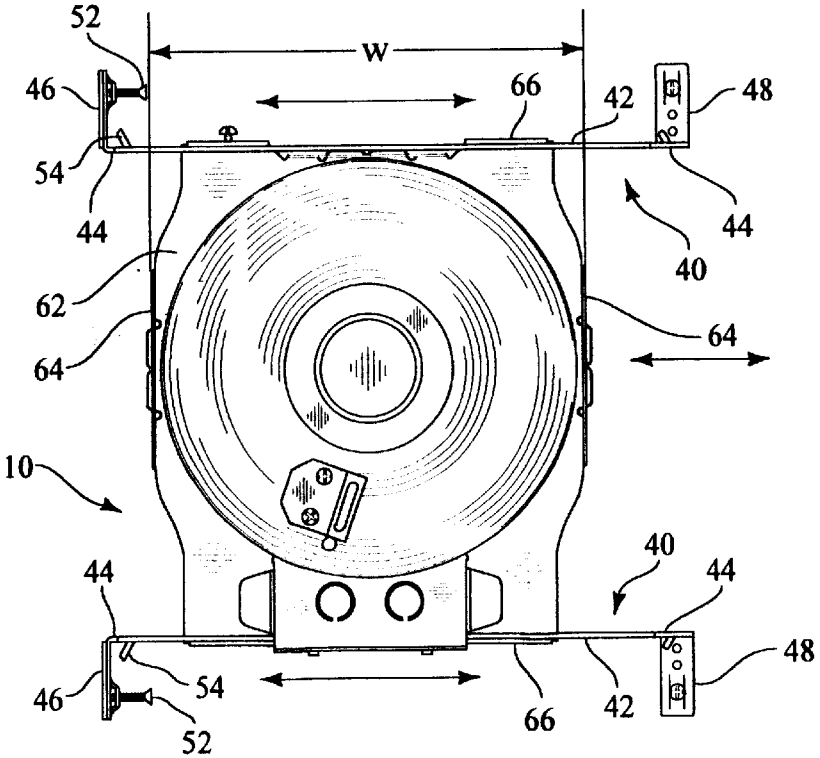
FIG. 6 is a top view of a recessed fixture frame of the present invention.

As shown in FIG. 6, a preferred embodiment of the recessed fixture frame of the present invention has a mounting frame section 10 and mounting bar assemblies 40.

Each mounting bar assembly 40 has a bar section 42 which has opposing ends 44. Located at each end 44 is a mounting stub 46, 48.

Figure 7:
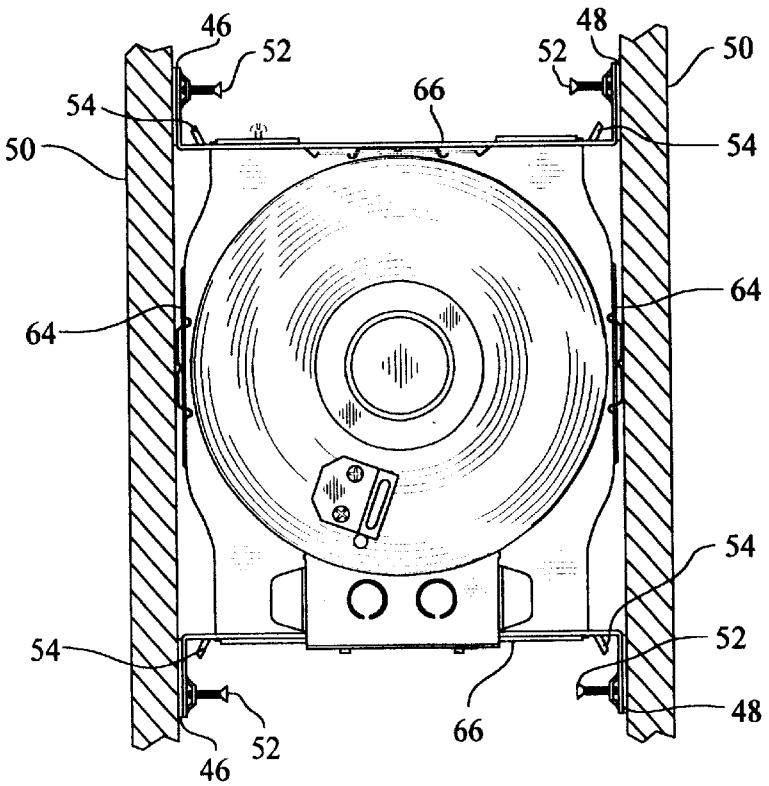
FIG. 7 is a top view of the recessed fixture frame of FIG. 6 installed between building structural members.

In use, as shown in FIG. 7, mounting stubs 46, 48 will be perpendicular to bar section 42 in order to abut building structural members 50. Mounting stubs 46, 48 may then be attached to building structural members, such as ceiling joists 50 by fasteners 52, which are preferably screws or nails.

Figure 9:
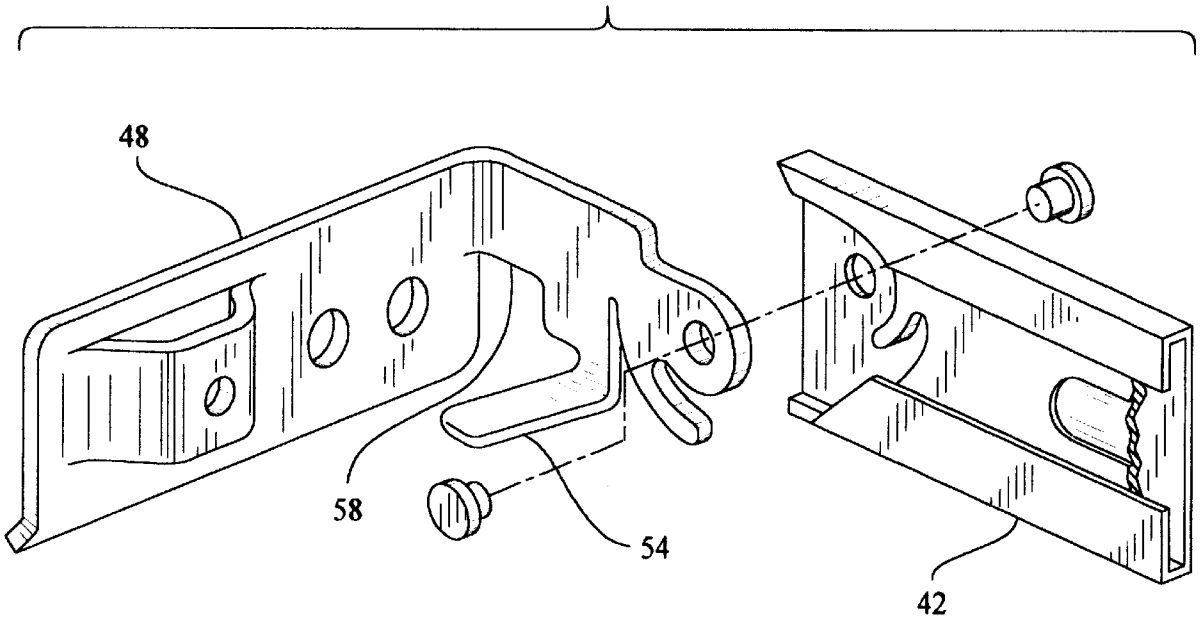
FIG. 9 is an enlarged exploded view of a pivotable mounting stub member of the recessed fixture frame of FIG. 6.

In the preferred embodiment, mounting stubs 48 are pivotably attached to bar section 42 to aid in installation. This design is described in detail in U.S. Pat. No. 5,957,573, incorporated herein by reference. Thus, FIG. 6 shows mounting stubs 48 in a pivoted position as used during installation, while FIG. 7 shows mounting stubs 48 in their final non-pivoted position after installation. FIG. 9 provides an enlarged exploded detail view of the mounting stub pivot mechanism.

Figure 8:
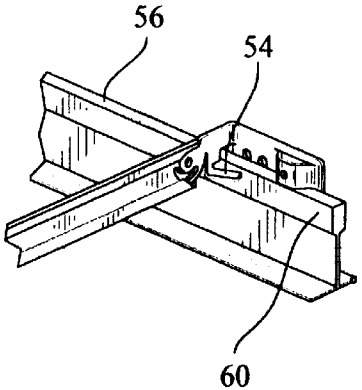
FIG. 8 is a partial perspective view of the recessed fixture frame mounting bar assembly of FIG. 6 installed on an inverted "T" bar structural member.

As shown in FIGS. 6 and 7, bendable tabs 54 protrude from the bar section 42 a short distance from each mounting stub 46. As shown in FIG. 8, bendable tabs 54 are used when installing the recessed fixture frame on an inverted "T" bar structural member 56. Bar section end 44 has a notch 58 between tab 54 and mounting stub 48. Notch 58 is sized to accept inverted "T" bar structural member bead 60. Thus, mounting bar assembly 40 may be positioned over inverted "T" bar structural member 56 such that notch 58 engages inverted "T" bar structural member bead 60. Bendable tab 54 may then be bent under inverted "T" bar structural member bead 60 to lock the mounting bar assembly 40 onto the inverted "T" bar structural member 56.

As shown in FIG. 6, mounting frame section 10 has a mounting frame plate 62, opposing side sections 64 and opposing end sections 66. Mounting frame plate 62 has a predetermined maximum width, w, measured between opposing sides 64, such that the mounting frame section 10 may fit between ceiling joists 50 or inverted "T" bar structural members 56.

Figure 10:
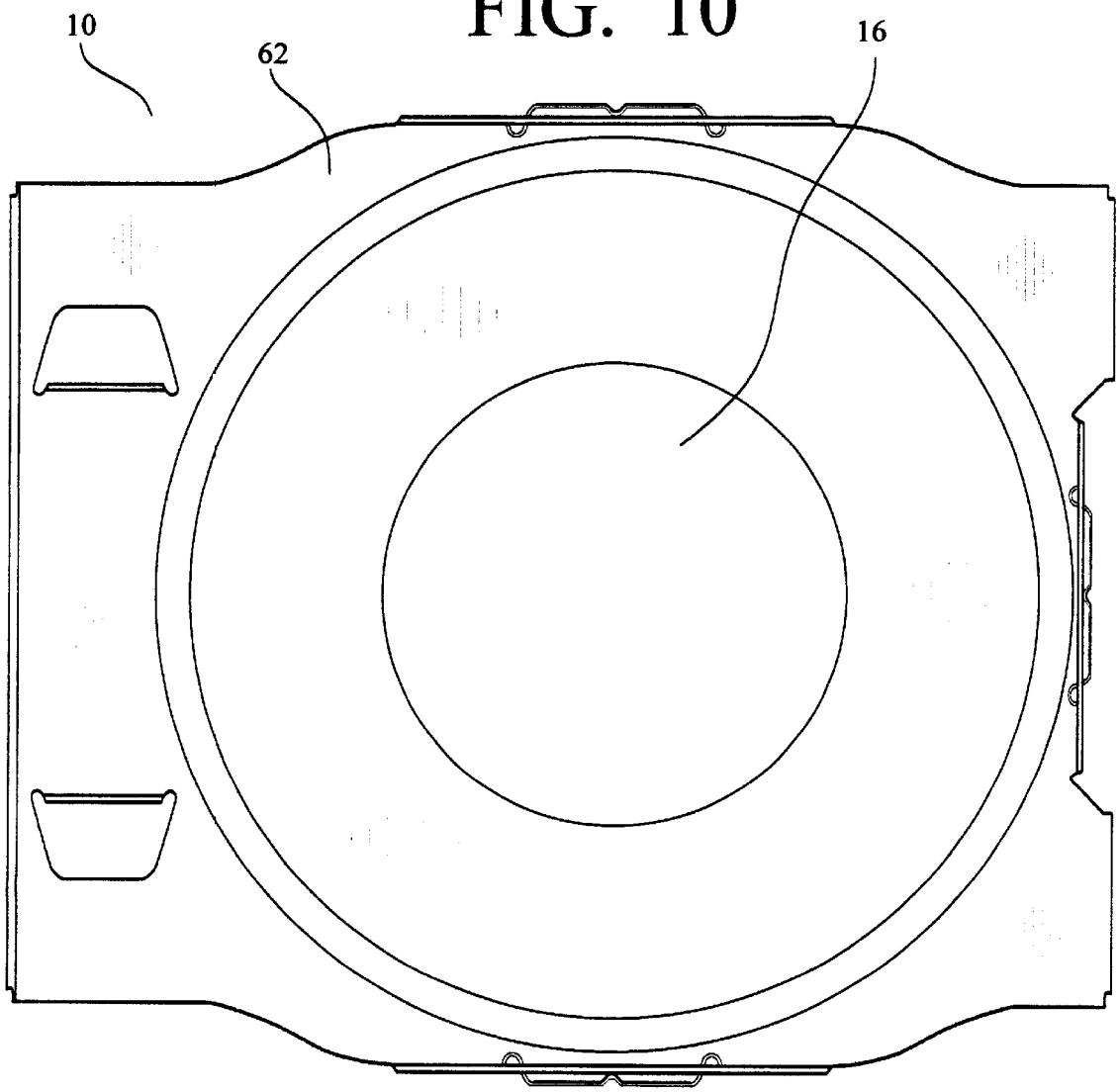
FIG. 10 is a top view of the mounting frame section of the recessed fixture frame of FIG. 6.

As shown in FIG. 10, the mounting frame section 10 of the preferred embodiment includes the circular central opening 16 for receiving the fixture appliance (not shown), such as a reflector/lamp assembly, of a recessed fixture. It should be understood that the opening 16 may be of any shape or location in the mounting frame section 10. However, a circular shape and central location has been selected for the preferred embodiment to allow compatibility with standard circular reflector trims and to provide optimal spacing from the fixture housing for dissipation of heat generated by a lamp.

As shown in FIG. 11, mounting frame section 10 also has mounting bar brackets 80 extending upward from the mounting frame plate 62 at each end section 66. A critical feature of the invention is that mounting bar brackets 80 are inset from each side 64 an amount sufficient to accommodate the mounting stubs 46, 48, notches 58 and tabs 54 of each mounting bar assembly 40

This detailed description is given primarily for clearness of understanding and no unnecessary limitations are to be understood therefrom for modifications will become obvious to those skilled in the art upon reading this disclosure and may be made without departing from the spirit of the present invention and scope of the appended claims.

What is claimed is:

1. A recessed fixture housing comprising:

a mounting frame section having a bottom and a raised wall extending therefrom;

a housing wall section having a bottom rim, a top rim and a side wall;

a housing cover section having a top and a skirt depending therefrom;

wherein said mounting frame raised wall and said housing wall section bottom rim are in an air-seal engagement; and wherein said housing wall section bottom rim and said housing cover section skirt are in an air-seal engagement.

2. The recessed fixture housing of claim 1 wherein said air-seal engagements are compressive air-seal engagements.

3. The recessed fixture housing of claim 1 wherein said air-seal engagements are taper fits between said mounting frame raised wall and said housing wall section bottom rim, and between said housing wall section top rim and said housing cover section skirt.

4. The recessed fixture housing of claim 3 wherein said taper fits are comprised of at least one surface of said mounting frame raised wall and said housing wall section bottom rim being tapered with respect to the other, and at least one surface of said housing wall section top rim and said housing cover section skirt being tapered with respect to the other.

5. The recessed fixture housing of claim 1 wherein said air-seal engagements are bevel fits between said mounting frame raised wall and said housing wall section bottom rim, and between said housing wall section bottom rim and said housing cover section skirt.

6. The recessed fixture housing of claim 5 wherein said bevel fits are comprised of at least one surface of said mounting frame raised wall and said housing wall section bottom rim being beveled with respect to the other, and at least one surface of said housing wall section top rim and said housing cover section skirt being beveled with respect to the other.

7. The recessed fixture housing of claim 1 wherein said air-seal engagements is comprised of at least one surface of said mounting frame raised wall and said housing wall section bottom rim being non-vertical, and at least one surface of said housing wall section top rim and said housing cover section skirt being non-vertical.

8. The recessed fixture housing of claim 2, said mounting frame section raised wall formed an outer face of an inverted v-shaped groove formed in said mounting frame bottom, and said housing wall section bottom rim being outwardly flexible, wherein said bottom rim is in compressive contact with said inverted v-shaped groove outer face creating said air-seal engagement.

9. The recessed fixture housing of claim 2, said housing wall section top rim being inwardly flexible, and said housing cover section skirt having an outward cant from said top, wherein said skirt is in compressive contact with said top rim creating said air-seal engagement.

10. A recessed fixture housing comprising:

a mounting frame section having a bottom and a raised wall extending therefrom;

a housing wall section having a bottom rim, a top rim and a side wall, said bottom rim sealingly engaging said mounting frame section raised wall; and a housing cover section having a top and a skirt depending therefrom, said skirt sealingly engaging said housing wall section top rim.

11. The recessed fixture housing of claim 10, said mounting frame bottom having an opening, said raised wall surrounding said opening.

12. The recessed fixture housing of claim 11, said mounting frame raised wall having an inward cant, said housing wall section bottom rim being outwardly flexible, wherein said bottom rim is in compressive contact with said inwardly canted raised wall creating said sealing engagement.

13. The recessed fixture housing of claim 12, said housing wall section bottom rim being held in compressive contact with said raised wall by at least one fastener.

14. The recessed fixture housing of claim 13, said mounting frame section further comprising at least one collar tab extending upward from the mounting frame section through which said at least one fastener holds said housing wall section in compressive contact with said raised wall.

15. The recessed fixture housing of claim 12, said mounting frame raised wall being the outer face of an inverted v-shaped groove.

16. The recessed fixture housing of claim 11, said housing wall section top rim being inwardly flexible, said housing cover section skirt having an outward cant from said top, wherein said skirt is in compressive contact with said top rim creating said sealing engagement.

17. The recessed fixture housing of claim 16, said housing cover section skirt being held in compressive contact with said housing wall section top rim by at least one fastener.

18. A recessed fixture housing comprising:

a mounting frame section having a bottom and a raised wall extending therefrom;

a housing wall section having a bottom rim, a top rim, and a side wall, said side wall having a junction box opening;

a housing cover section having a top and a skirt depending therefrom; and a junction box;

wherein said mounting frame raised wall and said housing wall section bottom rim are in an air-seal engagement; and wherein said housing wall section bottom rim and said housing cover section skirt are in an air-seal engagement; and wherein said junction box is received within said junction box opening.

19. The recessed fixture housing of claim 18, said mounting frame bottom having an opening, said raised wall surrounding said opening.

20. The recessed fixture housing of claim 19, said mounting frame raised wall having an inward cant, said housing wall section bottom rim being outwardly flexible, wherein said bottom rim is in compressive contact with said inwardly canted raised wall creating said air-seal engagement.

21. The recessed fixture housing of claim 20, said housing wall section bottom rim being held in compressive contact with said raised wall by at least one fastener.

22. The recessed fixture housing of claim 21, said mounting frame section further comprising at least one collar tab extending upward from the mounting frame section through which said at least one fastener holds said housing wall section in compressive contact with said raised wall.

23. The recessed fixture housing of claim 22, said mounting frame raised wall being the outer face of an inverted v-shaped groove.

24. The recessed fixture housing of claim 18, said housing wall section top rim being inwardly flexible, said housing cover section skirt having an outward cant from said top, wherein said skirt is in compressive contact with said top rim creating said air-seal engagement.

25. The recessed fixture housing of claim 24, said housing cover section skirt being held in compressive contact with said housing wall section top rim by at least one fastener.

26. The recessed fixture housing of claim 18, said junction box further comprising at least one access door, said access door being contoured to the surface of said housing wall section side wall, wherein said access door and said side wall are in an air-seal engagement, said air-seal engagement sealing said junction box opening.

27. The recessed fixture housing of claim 26, said junction box further having a fastener, wherein said access door is attached to said junction box and compressed against said side wall by said fastener.

28. The recessed housing of claim 27, said junction box further having sides, wherein said sides cooperate with the edges of the side wall along said junction box opening to hold the junction box within said junction box opening.

29. The recessed housing of claim 28, said junction box sides further having ribs, said junction box having a width slightly greater than the width of said junction box opening, wherein the side wall edges along said junction box opening seat in said ribs.

30. A recessed fixture housing comprising:

a mounting frame section having:

an opening; and a raised wall having an inward cant extending upward from the mounting frame and surrounding said opening;

a housing cover section having:

a top piece; and a skirt having an outward cant extending downward from the top piece, a housing wall section having:

an outwardly flexible bottom rim defining an open bottom, said bottom rim being smaller than the outer dimension of the mounting frame raised wall but larger than the inner dimension of the mounting frame raised wall; and an inwardly flexible top rim defining an open top, said top rim being smaller than the outer dimension of the housing cover skirt but larger than the inner dimension of the housing cover skirt;

said housing wall section positioned over said mounting frame section such that said outwardly flexible bottom rim is in compressive contact with said mounting frame raised wall creating a substantially air-tight seal;

said housing cover section positioned over said housing wall section such that said inwardly flexible top rim is in compressive contact with said housing cover section skirt creating a substantially air-tight seal.

31. The recessed fixture housing of claim 30, said housing wall section being held in compressive contact with said mounting frame section by at least one fastener, and said housing cover section being held in compressive contact with said housing wall section by at least one fastener.

32. The recessed fixture housing of claim 31, said fasteners being screws.

33. The recessed fixture housing of claim 31, said mounting frame section further comprising at least one collar tab extending upward from the mounting frame section through which said at least one fastener holds said housing wall section in compressive contact with said mounting frame section.

34. The recessed fixture housing of claim 30, said mounting frame raised wall being the outer face of an inverted v-shaped groove.

35. The recessed fixture housing of claim 30, said mounting frame raised wall and said housing cover skirt being substantially frustoconically shaped and said housing wall section being substantially cylindrically shaped.

* * * * *